United States Patent [19]

Pooyan

[11] Patent Number: 5,020,480

[45] Date of Patent: Jun. 4, 1991

[54] ARRANGEMENT FOR SECURING AND SEALING A COIL ASSEMBLY TO A BOILER

[75] Inventor: Samad Pooyan, Chappaqua, N.Y.

[73] Assignee: Ford Products Corporation, Valley Cottage, N.Y.

[21] Appl. No.: 549,625

[22] Filed: Jul. 6, 1990

Related U.S. Application Data

[63] Continuation of Ser. No. 453,764, Dec. 20, 1989, abandoned.

[51] Int. Cl.[5] ..... F22B 21/00

[52] U.S. Cl. ..... 122/249; 122/16; 122/19; 122/250 R

[58] Field of Search ..... 122/250 R, 250 S, 248, 122/249, 251, 252, 19, 16

[56] References Cited

U.S. PATENT DOCUMENTS 3,364,902 1/1968 Norton ..... 122/249

4,226,195 10/1980 Lindross ..... 110/234

4,550,689 11/1985 Wolter ..... 122/250 R 4,723,513 2/1988 Vallett et al. ..... 122/19

*Primary Examiner*—Edward G. Favors

*Attorney, Agent, or Firm*—Philip Furgang

[57] ABSTRACT

A tankless hot water heating coil assembly is releasably sealed in place with respect to the fire tube of a boiler: by extending a tubular tankless sleeve up from an opening through a top plate of the boiler; by positioning an O-Ring type seal atop an upper edge of the tankless sleeve by forming a groove in the O-Ring type seal and positioning the groove around the upper edge of the tankless sleeve; and by extending threaded fasteners through openings in a tankless coil plate which carries the tankless coil assembly and through tubular fastener positioning members secured about and to the outer wall of the tankless sleeve proximate the upper edge thereof.

26 Claims, 1 Drawing Sheet

ARRANGEMENT FOR SECURING AND SEALING A COIL ASSEMBLY TO A BOILER

This is a continuation of copending application Ser. No. 07/453,764 filed on Dec. 20, 1989 abandoned.

BACKGROUND OF THE INVENTION—FIELD OF APPLICATION

This invention relates to arrangements for sealing members together, and more particularly to arrangements for sealing coil assemblies to boilers.

BACKGROUND OF THE INVENTION —DESCRIPTION OF THE PRIOR ART

Numerous occasions arise when members must be secured together to form an assembly. In many instances the members are secured together by means such as threaded fasteners which permit a releasable connection between the members that permits separation of the members for selected purposes by release of the threaded fasteners. Some such members must, however, be secured together so that a fluid-tight, or substantially fluid-tight, seal is created between the members. Liquids, air and gases are the types of fluids which may need to be sealed into or out of a space which may be formed by or as a result of the members to be sealed together.

One proposed arrangement for securing and sealing members together is suggested in U.S. Pat. No. 3,054,975 granted on Sept. 18, 1962 to J. R. Barr for Seal For Transformer Casing And Method of Assembling Same while another such arrangement is suggested by U.S. Pat. No. 3,688,941 granted on Sept. 5, 1972 to C. Bildtsen for Arrangement For Producing A Seal Between A Container And A Lid. However, the arrangement proposed by J. R. Barr permanently secure the threaded fasteners to one of the members and requires a pair of members to form a resilient gasket-type seal between the members, while the C. Bildtsen proposal requires a flange encircling one of the members as well as a pair of members to effect a gasket-type seal. Permanently attached threaded fasteners such as those of the Barr proposal can create an undesirable construction if one or more of the members breaks or if the threads become stripped; while encircling flanges, such as that of the Bildtsen proposal may unduly add weight to the assembled device. Furthermore, the use in both such proposals of pairs of gasket-type sealing members requires positioning of such members with respect to each other and the members to be sealed together as well as cooperation between such members to form a seal all of which may unduly complicate and undesirably add to the relative cost of the sealing arrangement.

Another proposed sealing arrangement for a pair of members is suggested in U.S. Pat. No. 3,951,300 granted on Apr. 20, 1976 to K. Kalasek for Pressure Vessel. Such an arrangement requires peripheral flanges which unduly add to the relative weight and cost of the device, a relatively complex arrangement for securing the members together and a specially formed gasket which must be secured to one member and which must be fitted into a tapered groove in the other member to form a seal, all of which requires relatively expensive machining and relatively costly parts which can only unduly add to the cost of the device and sealing arrangement.

U.S. Pat. No. 3,187,929 issued on June 8, 1965 to R. W. Shaw, Jr., for Unitary Quick-Opening Closure Device positions an O-Ring type seal in a groove formed in one of the members and permanently attaches the threaded fastening devices on the other of the members. Such a sealing arrangement may prove to be undesirable because breakage of one or more of the fastening members or the stripping of the threads thereof will render same unusable and may present undue costs to render the fastening arrangement usable if possible at all; while the O-Ring type seal may fall out of its groove and be lost thus rendering the device unsealable or it may require tedious positioning thus undesirably complicating effective use of the device.

G. L. Hitz in U.S. Pat. No. 3,329,444 issued on July 4, 1967 for Self-Energizing Seal For High Pressure Flanged Connections also proposes encircling flanges which unduly add to the relative weight and cost of the device but furthermore requires a pair of O-Ring type seals cooperating with specially configured metallic annulus, all disposed in specially formed annular grooves; all of which would appear to unduly add to the relative cost of the device and its sealing arrangement and unduly complicate effecting the seal of the members to each other.

A sealing arrangement utilizing a grooved O-Ring type seal is proposed in U.S. Pat. No. 4,072,245 issued on Feb. 7, 1978 to P. H. Sloan, Jr., for Filler Neck Cap With O-Ring Seal. But, such an arrangement does not provide any means for releasably securing the members together and the seal is undesirably disposed between respective vertical sidewalls of the members disposed one with respect to the other. U.S. Pat. No. 2,550,493 issued to R. A. Ohlson on Apr. 24, 1951 for Dustproof Box suggests the use of a grooved sealing member carried by a first member for cooperation with a second member that is hingedly secured to the first member, and which employs only a single threaded fastener to further secure the members together. However, such a construction might be most undesirable because fastening the members together requires a very accurate alignment of a hole with an internally threaded opening which cannot be seen once one member is initially positioned with respect to the other and the respective members cannot be separated from each other once the fastening device is unfastened, thus creating a parts relationship which is limiting and undesirable as reducing the versatility of a releasable and sealable connection between two members. U.S. Pat. No. 2,475,836 issued on July 12, 1949 to K. Henricksen et al for Oil Pan Mounting For Motor Vehicles suggests the use of a grooved O-Ring type seal carried by one member for cooperation with another member to be secured thereto. But such a construction requires the formation of a circumferential groove in said other member to receive the seal member and the formation of cooperating circumferential flanges on both members to receive the fastening devices. Such circumferential flanges may very well unduly add to the relative weight and cost of construction of the respective members as will the formation of the seal receiving groove.

SUMMARY OF THE INVENTION

It is therefore an object of this invention to provide a new and improved arrangement for fastening and sealing two members together.

It is another object of this invention to provide a new and improved arrangement for releasably fastening and sealing two members together.

It is yet another object of this invention to provide a new and improved arrangement for sealing a coil assembly to a boiler.

It is still another object of this invention to provide a new and improved arrangement for releasably securing and sealing a coil assembly to a boiler.

It is yet still another object of this invention to provide a new and improved arrangement for releasably securing a tankless hot water heating coil assembly to a boiler.

Other objects, features and advantages of this invention in its details of construction and arrangement of parts will be seen from the above, from the description of the preferred embodiment when considered with the drawing and from the appended claims.

DESCRIPTION OF THE PREFERRED EMBODIMENT

Figure 1:
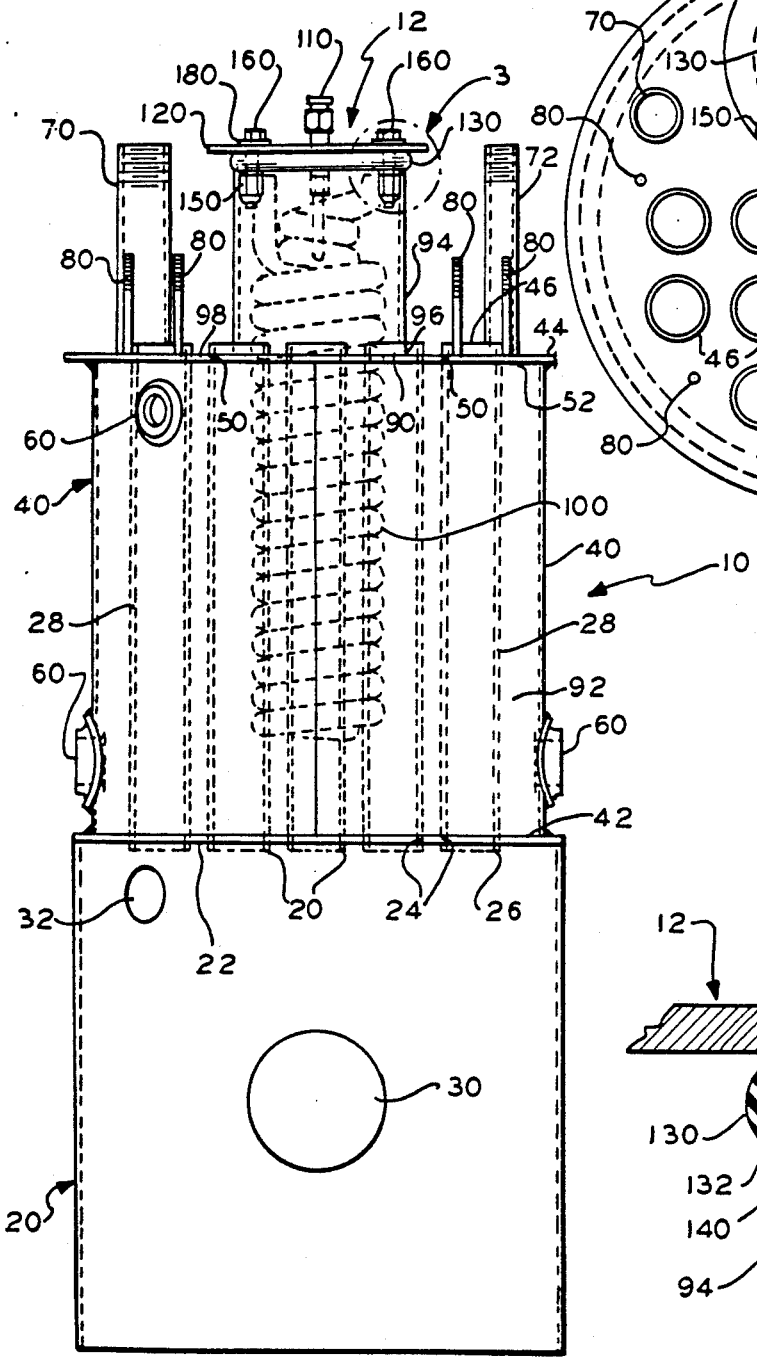
FIG. 1 is a vertical elevational view of a boiler showing a releasable fastening and sealing arrangement, incorporating the instant invention, between same and a tankless hot water heating coil assembly, parts being removed to better show details of the invention.
Figure 2:
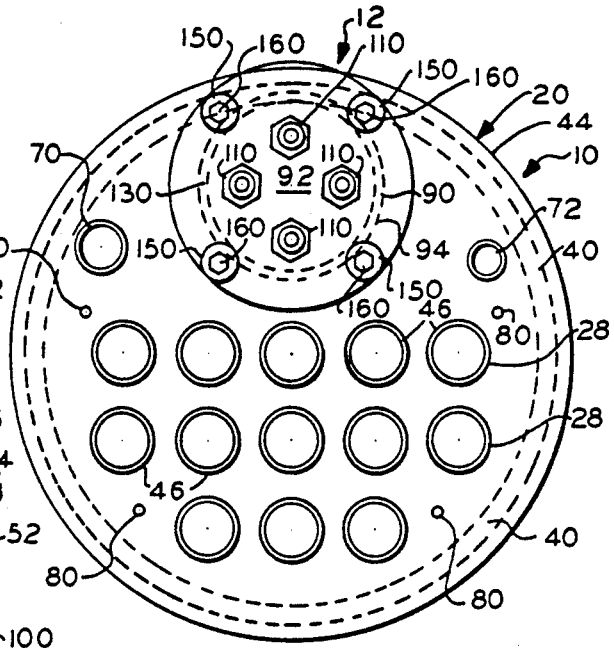
FIG. 2 is a plan view of the boiler and tankless hot water heating coil assembly of FIG. 1.

With reference to FIGS. 1 and 2, there is generally shown at 10 those portions of a boiler, of substantially conventional construction, to which are releasably secured and sealed according to this invention a tankless hot water coil assembly 12 otherwise of substantially conventional construction.

A skirt 20 is provided for boiler 10 and has affixed to the top thereof, as by welding or the like, a bottom tube plate 22 (FIG. 1) which is formed with a plurality of openings 24 through each of which extend the bottom 26 of a steel fire tube 28 (FIGS. 1 and 2) of conventional construction. Thirteen such steel fire tubes 28 are shown (FIG. 2) for boiler 10 arranged in two rows of five tubes each and one row of three tubes. Other arrangements may be provided for fire tubes 28 and more or less fire tubes 28 may be utilized depending upon the size, capacity, and purpose for boiler 10. Fire tubes 28 may be formed of other suitable material or materials. Bottoms 26 of fire tubes 28 are respectively secured within openings 24 of bottom tube plate 22 as by welding or other conventional securing means. Suitable openings, such as openings 30, 32 may be formed in skirt 20.

A PV shell 40 (FIGS. 1 and 2) extends up from bottom tube plate 22 and surrounds fire tubes 28. Shell 40 is formed from steel or other suitable material and is secured along a lower edge 42 (FIG. 1) to bottom tube plate 22 as by welding or other suitable and conventional means. A top tube plate 44 (FIGS. 1 and 2) is disposed proximate upper ends 46 of fire tubes 28 and is formed with a plurality of openings 50 (FIG. 1) through which said upper ends 46 of fire tubes 28 extend. Each fire tube 28 is secured in position in its respective opening 50 in top tube plate 44 as by welding or other suitable conventional means. An upper edge 52 of PV shell 40 is secured to top tube plate 44 also by welding or other suitable and conventional means. A plurality of conventional buckeyes 60 are disposed about and conventionally secured to PV shell 40.

A supply nipple 70 (FIGS. 1 and 2) and a PRV nipple 72, each of conventional construction, extend up from and are suitably and conventionally secured to top tube plate 44 for conventional purposes. In addition, a plurality of weld studs 80, each of conventional construction, also extend up from top tube plate 44 for conventional purposes.

Figure 3:
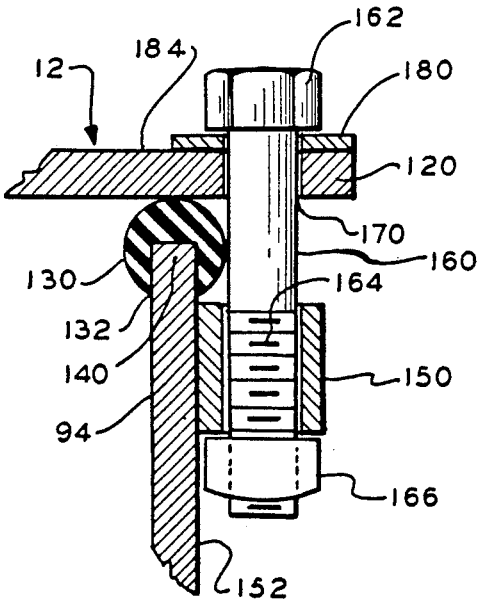
FIG. 3 is a partial sectional view of the portion of the boiler and tankless hot water heating coil assembly shown within circle "3" of FIG. 1 greatly enlarged to better show details of the members so shown.

An opening 90 is formed through top tube plate 44 to provide access into a space 92 formed within PV shell 40 and proximate fire tubes 28. A tankless sleeve 94, formed of steel or other suitable material, surrounds opening 90 and is secured along a lower end 96 (FIG. 1) thereof to a top surface 98 of top tube plate 28 as by welding or other suitable means. Opening 90, sleeve 96, and space 92 are of respective sizes and configurations to receive the coil 100 of tankless hot water coil assembly 12 and permit same to extend into space 92 proximate fire tubes 28 as shown in FIGS. 1 and 2. Suitable and conventional nipples 110 (FIG. 2) extend through a coil assembly plate 120 of coil assembly 12 (FIGS. 1–3) to facilitate connection of coil 100 to other conduits for fluid conduction. Coil 100 is of tubular material and conventionally formed to permit the passage therethrough of water to be heated, while passing therethrough, through the conventional interaction of such water with heat from fire tubes 28.

An O-Ring type seal 130, formed from conventional materials utilized for this purpose, is formed with a groove 132 (FIG. 3) of a size and configuration to permit a snug fit of seal 130 on top of and surrounding an upper edge 140 of tankless sleeve 94. A plurality of tubular fastener positioning members 150 (FIGS. 1–3) are each secured to an outer wall 152 (FIG. 3) of tankless sleeve 94 as by welding or other suitable conventional means. In this instance four such positioning members 150 are so utilized. Each such member 150 is of a size and configuration to receive a threaded fastening member 160 which may be, for example, a conventional and suitably sized cap screw each including a head 162 (FIG. 3) and an externally threaded shank 164 which receives an internally threaded nut 166. Such threaded fasteners 160 are respectively disposed with their threaded shanks 164 extending through suitably formed and positioned holes 170 which extend through coil assembly plate 120. If desired flat washers 180, of conventional size, configuration and construction, may be disposed between heads 162 of fasteners 160 and a top surface 184 of coil assembly plate 120. When threaded fasteners are tightened a lower surface of their respective heads 162 bears upon an upper surface of plate 184 while an upper surface of its respective nut 166 bears against a lower surface of its respective positioning member 150.

By tightening fasteners 160 into their respective nuts 166 coil assembly plate 120 and tankless coil assembly 12 are securely but removably secured in position with respect to boiler 10 and its fire tubes 28. An effective seal for coil assembly plate 120 and tankless coil assembly 12 within tankless sleeve 94 and space 92 is thus provided between plate 120 and sleeve 94 by seal 130 as fasteners 160 are so tightened.

When heat is applied to space 92 through fire tubes 28 and as a result of combustion of a suitable fuel, such as oil, gas or the like, through conventional means provided for boiler 10, the heat so applied to space 92 will, in turn, heat up coil assembly 100 and any water or other fluid passing through same. Water to be passed through coil assembly 12, 100 is fed thereinto through the appropriate feed lines (not shown) conventionally connected to one of the nipples 110 and is fed from coil assembly 12, 100 through other suitable and conventional feed lines (not shown) conventionally connected to other ones of the nipples 110 and therefrom to the location requiring same.

From the above description it will thus be seen that there has been provided a novel and improved boiler and hot water heating means by providing a novel and improved releasable and sealable connection between a tankless hot water coil assembly and the boiler which receives same.

It is understood that although there has been shown a preferred embodiment of this invention that various modifications may be made in the details thereof without departing from the spirit as comprehended by the following claims.

What is claimed is:

1. An arrangement for securing and sealing a coil assembly to a boiler including boiler walls defining the boiler and a chamber therewithin wherein boiler fire tubes are disposed and within which a space is provided of a predetermined size and configuration sufficient to receive at least a first portion of the coil assembly; comprising:

(a) an opening formed through a wall of the boiler proximate the space provided therewithin;

(b) sleeve means including wall means having a first wall end secured to the boiler in proximity to and so as to surround said opening, and extending from said first wall end to a second wall end spaced from said first wall end and defining within said wall means an area of a predetermined size and configuration to receive therewithin at least a second portion of the coil assembly;

(c) resilient sealing means disposed along said second wall end and so as to extend downwardly therefrom so as to remain disposed in position thereon;

(d) coil assembly plate means carrying the coil assembly and being formed to a size and configuration to be positioned upon said resilient sealing means when disposed along said second wall end and for cooperation therewith;

(e) a plurality of releasable fastening means each extending through a respective fastener opening formed through said coil assembly plate means and in spaced relationship thereabout and through a tubular fastener positioner means carried by said sleeve means in alignment with a respective one of said fastener openings such that when fastened said coil assembly plate means is secured in position upon said second wall end of said sleeve means and said resilient sealing means is squeezed therebetween to provide an effective seal between said second end of said sleeve means and said coil assembly plate means.

2. The sealing arrangement of claim 1, wherein said opening formed through the boiler is substantially circular and said sleeve means is substantially tubular.

3. The sealing arrangement of calim 2, wherein said resilient sealing means is substantially in the configuration of a midified O-Ring type seal which is formed to extend from said second wall end along at least one wall surface of said sleeve means when disposed upon said second wall end.

4. The sealing arrangement of claim 3, wherein said resilient sealing means extends down from said second wall end along both inner and outer surfaces of said sleeve means when disposed upon said second wall end.

5. The sealing arrangement of claim 4, wherein said O-Ring type seal is formed with a groove extending thereabout to facilitate disposition of said resilient sealing means upon said second wall end and so that said resilient sealing means extends down along said inner and outer surfaces of said sleeve means.

6. The sealing arrangement of claim 3, wherein said coil assembly plate means is also substantially circular and is of greater diameter than the diameter of said tubular sleeve means.

7. The sealing arrangement of claim 6, wherein a plurality of tubular fastener positioning means are secured to said sleeve means in spaced relationship with respect to each other and about an outer surface of said sleeve means, each of said tubular fastener means being in the configuration of a relatively short tube.

8. The sealing arrangement of claim 7, wherein each said tubular fastener positioner means is disposed with its tube extending substantially parallel to said wall means of said sleeve means.

9. The sealing arrangement of claim 8, wherein each of said releasable fastening means includes an externally threaded fastener with a head and an internally threaded nut to be disposed for coaction with said external threads.

10. The sealing arrangement of claim 9, wherein said fastener openings formed through said coil assembly plate are formed to align with a respective one of said fastener positioner means and said releasable fastening means when disposed for coaction therewith are each disposed with a respective head positioned on top of said coil assembly plate and with its respective nut coating with a bottom surface of a respective tubular fastener positioner means to secure said coil assembly plate to said sleeve means with said resilient seal therebetween.

11. The sealing arrangement of claim 1, wherein said sleeve means provides a tankless sleeve and said coil assembly is a tankless coil assembly.

12. The sealing arrangement of claim 1, wherein said tankless coil assembly receives and conducts a fluid therethrough and conducts heat to the fluid when the coil assembly is disposed with the space within the boiler.

13. The sealing arrangement of claim 12, wherein the fluid is water.

14. An arrangement for securing and sealing a coil assembly to a boiler including boiler walls defining the boiler and a chamber therewithin wherein boiler fire tubes are disposed and within which a space is provided of a predetermined size and configuration sufficient to receive at least a first portion of the coil assembly; comprising:

(a) an opening formed through a wall of the boiler proximate the space provided therewithin;

(b) wall means having a first wall end disposed in proximity to and so as to surround said opening, and extending from said first wall end to a second wall end spaced from said first wall end and defining within said wall means an area of a predetermined size and configuration to receive therewithin at least a second portion of the coil assembly;

(c) resilient sealing means disposed along said second wall end so as to remain disposed in position thereon;

(d) the coil assembly being formed to a size and configuration to be positioned upon said resilient sealing means for cooperation therewith;

(e) a plurality of releasable fastening means each cooperating with the coil assembly and a respective fastener positioner means carried by said wall means such that when fastened said coil assembly is secured in position upon said second wall end of said wall means and said resilient sealing means is squeezed therebetween to provide an effective seal between said second end of said wall means and said coil assembly.

15. The sealing arrangement of claim 14, wherein said opening formed through the boiler is substantially circular and said wall means is substantially tubular.

16. The sealing arrangement of claim 15, wherein said resilient sealing means is substantially in the configuration of a modified O-Ring type seal which is formed to extend from said second wall end along at least one wall surface of said wall means when disposed upon said second wall end.

17. The sealing arrangement of claim 16, wherein said resilient sealing means extends down from said second wall end along both inner and outer surfaces of said wall means when disposed upon said second wall end.

18. The sealing arrangement of claim 17, wherein said O-Ring type seal is formed with a groove extending thereabout to facilitate disposition of said resilient sealing means upon said second wall end and so that said resilient sealing means extends down along said inner and outer surfaces of said wall means.

19. The sealing arrangement of claim 16, wherein the assembly includes a plate means which is also substantially circular and is of greater diameter than the diameter of said tubular wall means.

20. The sealing arrangement of claim 19, wherein a plurality of tubular fastener positioning means are secured to said wall means in spaced relationship with respect to each other and about an outer surface of said wall means, each of said tubular fastener means being in the configuration of a relatively short tube.

21. The sealing arrangement of claim 20, wherein each said tubular fastener positioner means is disposed with its tube extending substantially parallel to said wall means.

22. The sealing arrangement of claim 21, wherein each of said releasable fastening means includes an externally threaded fastener with a head and an internally threaded nut to be disposed for coaction with said external threads.

23. The sealing arrangement of claim 22, wherein a plurality of fastener openings are formed through said coil assembly plate means to align with a respective one of said fastener positioner means and said releasable fastening means when disposed for coaction therewith are each disposed with a respective head positioned on top of said coil assembly plate means and with its respective nut coacting with a bottom surface of a respective tubular fastener positioner means to secure said coil assembly plate means to said wall means with said resilient seal therebetween.

24. The sealing arrangement of claim 14, wherein said wall means includes a sleeve means providing a tankless sleeve and the coil assembly is a tankless coil assembly.

25. The sealing arrangement of claim 24, wherein said tankless coil assembly receives and conducts a fluid therethrough and conducts heat to the fluid when the coil assembly is disposed within the space within the boiler.

26. The sealing arrangement of claim 25, wherein the fluid is water.

* * * * *